United States Patent [19]

Bell, III

[11] Patent Number: 4,862,949

[45] Date of Patent: Sep. 5, 1989

[54] REGENERATOR SEAL ASSEMBLY

[75] Inventor: Albert H. Bell, III, Birmingham, Mich.

[73] Assignee: General Motors Corporation, Detroit, Mich.

[21] Appl. No.: 95,098

[22] Filed: Sep. 8, 1987

[51] Int. Cl.[4] ..... F28D 19/00

[52] U.S. Cl. ..... 165/9; 277/83

[58] Field of Search ..... 165/9; 277/83

[56] References Cited

U.S. PATENT DOCUMENTS

| | | | |
|---|---|---|---|
| 3,190,351 | 6/1965 | Savonuzzi | 165/9 |
| 3,351,127 | 11/1967 | Mendelsohn . | |
| 3,534,808 | 10/1970 | Carroll . | |
| 3,542,122 | 11/1970 | Bracken . | |
| 3,622,737 | 11/1971 | Trudeau | 165/9 |
| 3,743,008 | 7/1973 | Zeek et al. . | |
| 3,780,791 | 12/1973 | Barnard et al. . | |
| 3,805,882 | 4/1974 | Vallance . | |
| 3,856,077 | 12/1974 | Siegla . | |
| 3,954,135 | 5/1976 | Hewlitt . | |
| 4,024,906 | 5/1977 | Bramley . | |
| 4,098,323 | 7/1978 | Wiegard et al. . | |
| 4,105,062 | 8/1978 | Bell et al. . | |
| 4,183,539 | 1/1980 | French et al. | 165/9 |
| 4,305,594 | 12/1981 | Hakda | 165/9 |
| 4,373,575 | 2/1983 | Hayes . | |

FOREIGN PATENT DOCUMENTS

| | | | |
|---|---|---|---|
| 208592 | 12/1983 | Japan | 165/9 |

*Primary Examiner*—Albert W. Davis, Jr.
*Attorney, Agent, or Firm*—Saul Schwartz

[57] ABSTRACT

A regenerator seal assembly including a flat platform having a wear face slidably engaging a matrix disc and an opposite seal face, a plurality of naturally planar thin and flexible metal strips arrayed in end-to-end overlapping relationship on a bevel surface of the engine adjoining the matrix disc with an outer edge of each strip engaging the platform seal face and forming a gas seal thereat, an elastomeric seal element in a groove in the bevel surface engaging a high pressure side of each metal strip to define a gas seal between the elastomeric element and the metal strips, and a retaining shoe engaging a low pressure side of each metal strip and pressing the latter against the elastomeric element with sufficient force to effect the aforesaid gas seal but with insufficient force to rididly attach the metal strips to the bevel surface. The metal strips slide relative to the bevel surface when the gap between the matrix disc and the engine changes due to thermal distortion of the disc so that stress concentrations in the metal strips are avoided.

5 Claims, 2 Drawing Sheets

REGENERATOR SEAL ASSEMBLY

BACKGROUND OF THE INVENTION

1. Field of the Invention

This invention relates generally to regenerators in gas turbine engines and, more particularly, to a seal assembly for the gaps between a regenerator matrix disc and adjoining portions of the gas turbine engine.

2. Description of the Prior Art

In typical gas turbine regenerator systems, a matrix disc is mounted on the engine for rotation about an axis perpendicular to nominally flat circular end surfaces of the disc. The disc rotates through streams of hot exhaust gas and relatively cold compressed air and thereby transfers heat from the hot stream to the cold stream. Because leakage from and/or between the streams must be minimized, leaf-type seal assemblies have been proposed in which a thin metal strip with an integral mounting flange along one edge is rigidly attached at the mounting flange to the engine while the other edge of the strip bears against a seal face of a flat platform disposed between the matrix disc and the metal strip. The platform functions to isolate the metal strip from rotation of the disc. Thermal gradient induced warpage or distortion of the matrix disc and platform during operation creates localized reductions in the gap between the platform and the adjoining portion of the engine. The local reductions in gap dimension tend to flex the metal strips relative to their initial configuration which flexure is resisted at the junction between the flange and the seal strip. Accordingly, it is characteristic of such seals that fatigue inducing stress concentrations develop at the junctions between the attaching flanges and the remainders of the strips. A seal assembly according to this invention seals the gap between the matrix disc and the engine with metal strips which are not rigidly clamped along either edge so that development of stress concentrations is avoided.

SUMMARY OF THE INVENTION

This invention is a new and improved seal assembly for the gap between an end surface of a regenerator matrix disc supported on a gas turbine engine for rotation about an axis perpendicular to the end surface and a ledge on an adjoining portion of the engine block, the seal assembly separating a relatively higher pressure zone of the engine and a relatively lower pressure zone of the engine. A rim seal application of the new and improved seal assembly includes a flat platform nonrotatably mounted on the engine between the end surface of the matrix disc and the ledge with a wear face on the platform engaging the disc, a frustoconical bevel surface on the ledge facing the low pressure zone of the engine, an elastomeric seal element in a groove in the bevel surface, a normally flat flexible metal strip mounted on the bevel surface for limited sliding movement with one side engaged by the elastomeric seal element and one edge engaging a seal face on the platform opposite the wear face, and an arcuate retaining shoe attached to the engine over the metal strip pressing the latter against the elastomeric seal element without foreclosing sliding of the metal strip relative to the bevel surface. Because the metal strip is normally flat and because it is not rigidly attached to the engine, the thermal distortion of the matrix disc which tends to flatten the metal strip is accompanied by natural unflexing of the strip toward its flat condition with corresponding relative sliding movement between portions of the strip and the engine. In a preferred rim seal embodiment, the metal strip is a composite consisting of a plurality of shorter metal strips arranged on the frustoconical bevel surface in end-to-end overlapping relationship, each of the shorter metal strips being connected to the bevel surface for limited sliding movement relative thereto and being pressed against the elastomeric seal element by the arcuate retaining shoe.

DESCRIPTION OF THE DRAWINGS

Referring now to FIG. 1 of the drawings, a generally cylindrical regenerator compartment 12 is defined within an annular wall 14 of a partially illustrated engine block 15 of a gas turbine engine. The regenerator compartment is closed on one side by a circular wall 16 of a cover 17 rigidly attached to the annular wall 14. The regenerator compartment is closed on the other side by a circular wall 18 integral with the engine block 15. A regenerator matrix disc 20 is disposed in the regenerator compartment 12 with a first nominally flat circular end face 22 facing the wall 16 and a second nominally flat circular end face 26 facing the circular wall 18.

Figure 1:
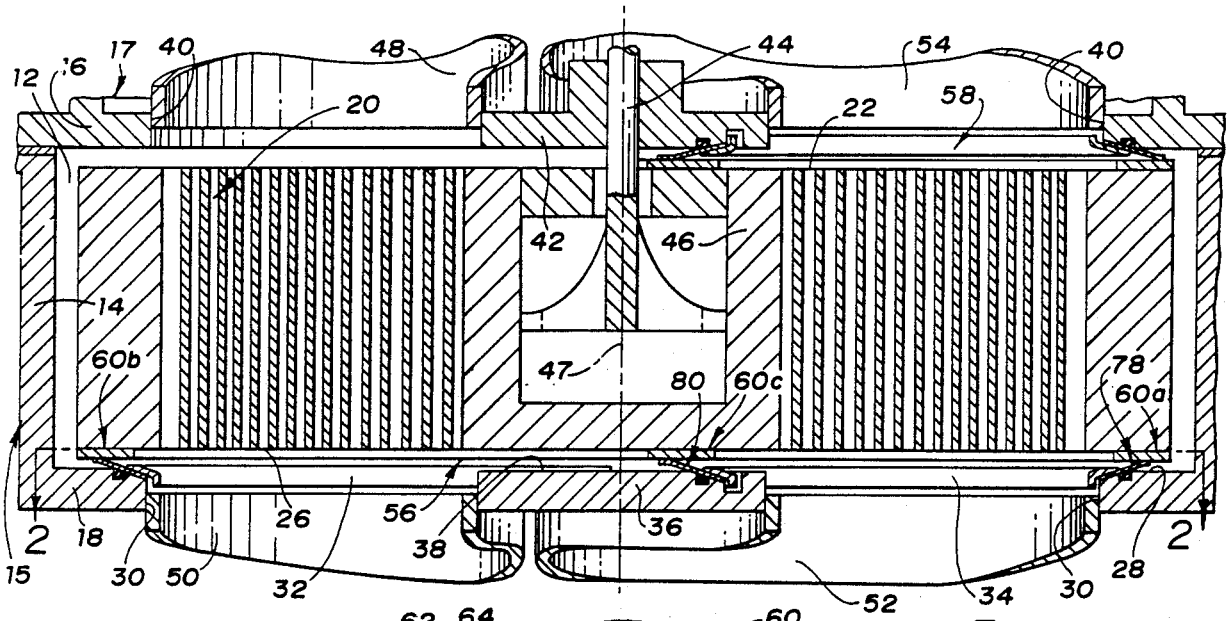
FIG. 1 is a schematic sectional view of a gas turbine regenerator system including a seal assembly according to this invention.

An annular rim seal ledge 28 is defined on the side of the wall 18 facing the matrix disc around a circular opening 30 in the wall 18. The circular opening 30 is divided into two generally D-shaped sectors 32 and 34 by a cross arm 36 of the engine block. A cross arm seal ledge 38 on top of the cross arm 36 is coplanar with and merges with the rim seal ledge 28 so that a continuous ledge is defined around both D-shaped sectors 32 and 34. A circular opening 40 in the cover 17 is similarly divided into two generally D-shaped sectors by a cover cross arm 42 and a ledge extends around both sectors. A shaft 44 rotatably journaled on the cover cross arm 42 is connected to a hub 46 of the matrix disc 20 whereby the disc is rotated within the regenerator compartment 12 about an axis 47 generally perpendicular to the circular end faces 22 and 26 of the disc.

A first air duct 48 connected to the cover 17 conveys relatively cold compressed air to the regenerator compartment 12 through one of the D-shaped sectors of the circular opening 40. A second air duct 50 conveys heated compressed air from the regenerator compartment 12 through the corresponding D-shaped sector 32. A first exhaust duct 52 conveys hot, relatively low pressure exhaust gas to the regenerator compartment 12 through the D-shaped sector 34. A second exhaust duct 54 conveys cooled low pressure exhaust gas from the regenerator compartment 12 through the corresponding other D-shaped sector of the circular opening 40 in the cover 17.

The interior of the air ducts 48 and 50, as well as the portion of the regenerator compartment 12 around the circumference of the matrix disc 20 represents a high pressure zone of the gas turbine engine relative to a low pressure zone of the engine defined by the interiors of the exhaust ducts 52 and 54. In addition, the portion of the regenerator compartment 12 around the circumference of the matrix disc 20 represents a high pressure zone of the engine relative to a low pressure zone defined within the second air duct 50 due to the relatively small pressure drop across the matrix disc between the first air duct 48 and the second air duct. A seal assembly 56 according to this invention is disposed in the gap between the second circular end face 26 of the matrix disc and the rim seal ledge 28 and the cross arm seal ledge 38 and operates to prevent incursion of the high pressure compressed air into the low pressure hot exhaust gases and to restrict incursion of cold compressed air into the hot compressed air stream. A seal assembly 58 is disposed in the gap between the end surface 22 of the matrix disc 20 and the cover 17 around the D-shaped sector through which the hot exhaust gases flow to the second exhaust duct 54. Because the seal assembly 58 is essentially the same as seal assembly 56 only the latter is described below.

Figure 2:
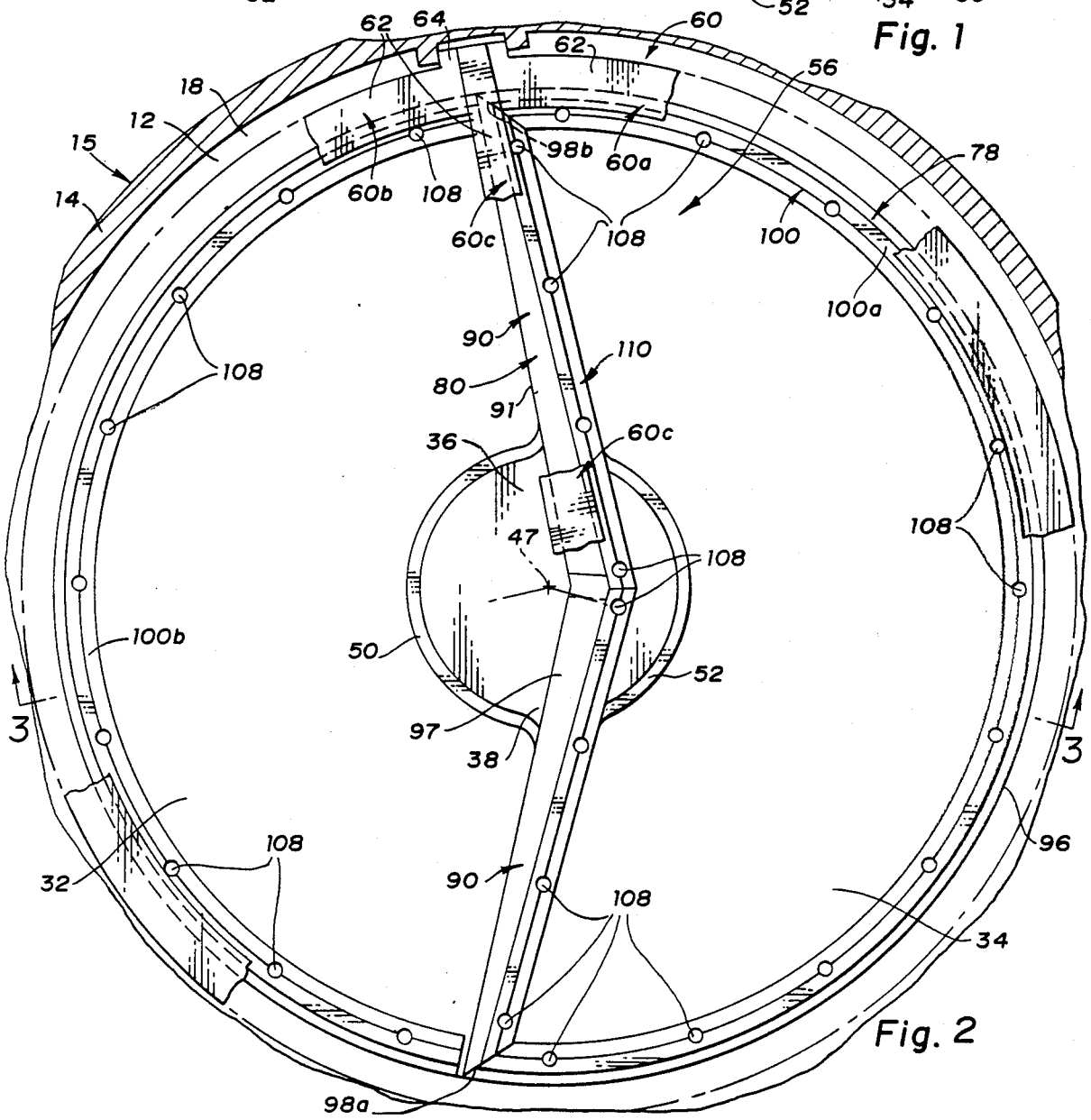
FIG. 2 is an enlarged partially broken away sectional view taken generally along the plane indicated by lines 2—2 in FIG. 1.
Figure 3:
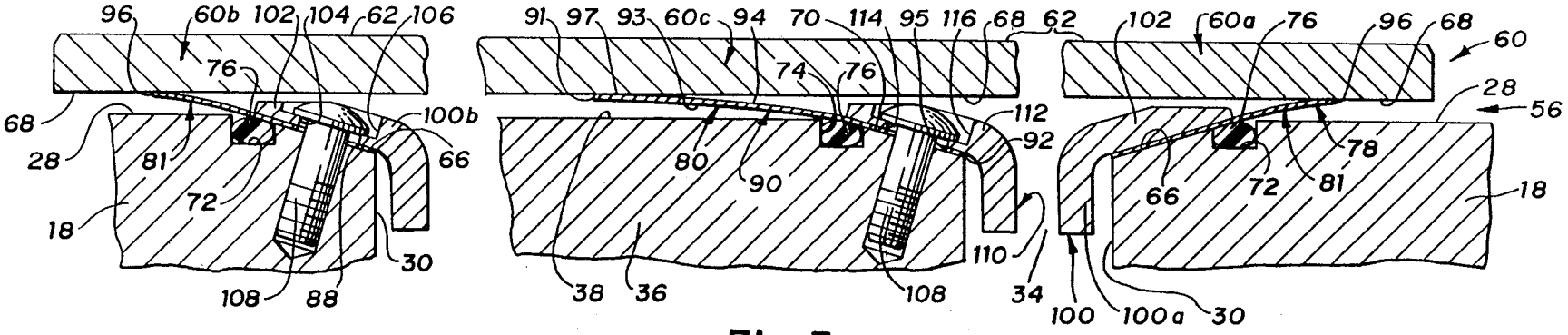
FIG. 3 is an enlarged sectional view taken generally along the plane indicated by lines 3—3 in FIG. 2.
Figure 4:
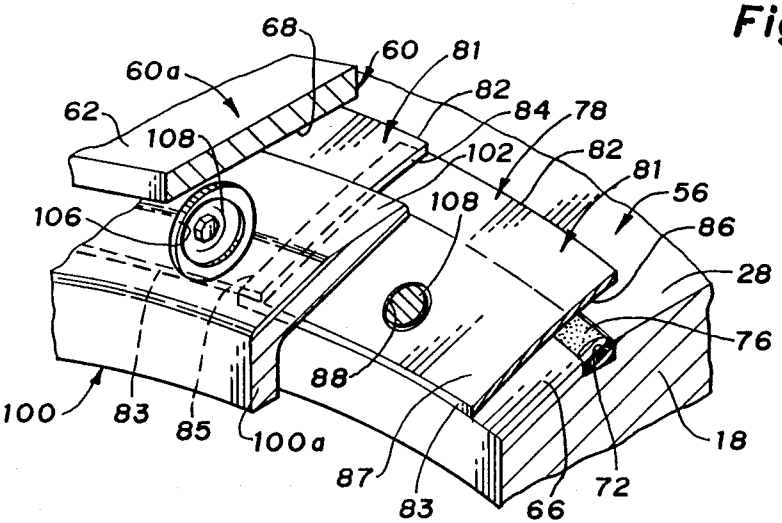
FIG. 4 is a fragmentary perspective view of the seal assembly according to this invention.

Referring now to FIGS. 2–4, the seal assembly 56 includes a flat platform 60 between the engine block and the matrix disc with of a pair of arc shaped sections **60*a* and 60*b* overlying the rim and ledge 28 and a section 60*c* overlying the cross arm ledge 38. A wear face 62 on the platform, FIGS. 3 and 4, slidingly and sealingly engages the end surface 26 of the matrix disc. The platform 60 has radially extending lugs, as for example a lug 64 illustrated in FIG. 2, which engage appropriate shoulders on the engine block whereby rotation of the platform about the axis 47 is foreclosed while the platform retains limited mobility in the direction of the axis 47**.

The seal assembly 56 further includes a rim seal frustoconical bevel surface 66 on the rim seal ledge 28 around the circular opening 30 in the wall 18. The bevel surface 66 defines a shallow angle relative to the plane of a nominally flat seal face 68 on the platform 60. The cross arm seal ledge 38 has a similar cross arm bevel surface 70 thereon defining the same shallow angle relative to the plane of platform seal face 68. Accordingly, a continuous bevel surface is defined around and facing the low pressure zone of the engine as represented by D-shaped sector 34. Similarly, the portion of the rim seal bevel surface 66 around the D-shaped sector 32 likewise faces the zone of lower pressure within second air duct 50 relative to the portion of the regenerator compartment outside the second air duct.

As seen best in FIGS. 3 and 4, in a preferred embodiment of the seal assembly 56, the rim seal ledge 28 has a circular groove 72 therein at the intersection of the rim seal bevel surface 66 and the rim seal ledge 28. The cross arm ledge 38 has a linear groove 74 therein paralleling the edge of the cross arm at the intersection of the cross arm bevel surface 70 and the cross arm ledge 38. The groove 74 extends the length of the cross arm 36 and intersects the groove 72 at generally diametrically opposite locations. A continuous high temperature resistant elastomeric seal element 76 having a generally circular cross-section is seated in the grooves 72 and 74 and projects above corresponding ones of the rim seal bevel surface 66 and the cross arm bevel surface 70.

The seal assembly 56 further includes a circular composite rim seal leaf 78 and a generally linear composite cross arm seal leaf 80. The rim seal leaf 78 consists of a plurality of relatively short rim seal metal strips of which only two metal strips 81 are illustrated in FIG. 4. Each rim seal metal strip is thin and flexible, flat in an unflexed or unstressed condition, and slightly arcuate in planar shape. Each rim seal metal strip has an outer edge 82 and an inner edge 83 extending in the direction of the length dimension of the strip, a pair of ends 84 and 85 extending in the direction of the width dimension of the strip, a high pressure side 86, a low pressure side 87, and a longitudinally spaced pair of clearance holes 88.

Figure 6:
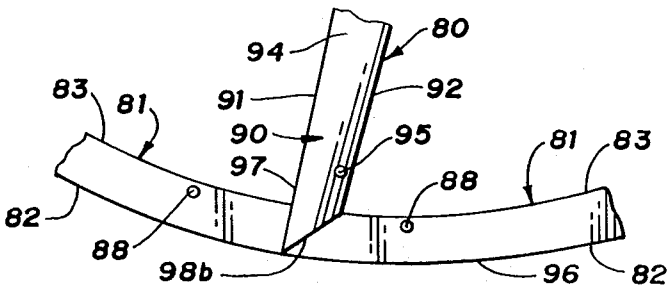
FIG. 6 is a plan view of a portion of the seal assembly according to this invention and illustrating one of the junctures between rim seal and cross arm seal portions of the seal assembly.

The cross arm seal leaf 80 typically consists of two cross arm metal strips 90, FIG. 2, which are thin and flexible and flat in an unflexed or unstressed condition. Each cross arm metal strip has an outer edge 91 and an inner edge 92, FIG. 3, extending in the direction of the length dimension of the strip, a high pressure side 93, and a low pressure side 94. The cross arm metal strips also have a plurality of longitudinally spaced clearance holes 95 therein, FIGS. 3 and 6.

The rim seal metal strips 81 are arrayed on the rim seal bevel surface 66 in end-to-end overlapping fashion, FIG. 4, and are flexed in the length direction to assume the frustoconical shape of the rim seal bevel surface. The high pressure side 86 of each metal strip bears against the rim seal bevel surface and against the elastomeric seal element 76. The outer edge 82 of each rim seal metal strip 81 bears against the platform seal face 68 in substantially line contact. Thus arrayed, the outer edges 82 of the rim seal metal strips cooperate to define a circular rim seal lip 96, FIGS. 2 and 3, whereat the composite rim seal leaf 78 engages the platform seal face 68. Likewise, the high pressure sides 86 and the low pressure sides 87 of the arrayed rim seal metal strips cooperate to define, respectively, a continuous high pressure side of the composite rim seal leaf 78 engaging the rim seal bevel surface 66 and the elastomeric seal element 76 and a continuous low pressure surface facing the aforesaid relatively lower pressure zones of the engine.

The cross arm metal strips 90 are arrayed on the cross arm bevel surface 70 in end-to-end overlapping fashion. Because the bevel surface 70 is flat, the metal strips 90 are flat when thus arrayed. The high pressure side 93 of each cross arm metal strip bears against the cross arm bevel surface and against the elastomeric seal element 76. The outer edge 91 of each cross arm metal strip 90 bears against the platform seal face 68 in substantially line contact and cooperates with the corresponding outer edge on the other cross arm metal strip to define a linear cross arm seal lip 97, FIGS. 2 and 3, which intersects the rim seal lip 96 at generally diametrically opposite locations **98*a* and 98*b*. The high pressure sides 93 and the low pressure sides 94 of the arrayed cross arm metal strips cooperate to define, respectively, a continuous high pressure side of the composite cross arm seal leaf 80 engaging the cross arm bevel surface 70 and the elastomeric seal element 76 and a continuous low pressure side facing the aforesaid relatively lower pressure zone of the engine within first exhaust duct 52**.

As seen best in FIGS. 2, 3 and 4, the composite rim seal leaf 78 is held on the engine by a circular retaining shoe 100 fabricated as two arc shaped shoe segments 100*a* and 100*b*. The retaining shoe 100 includes a generally frustroconically shaped flange portion 102 having a plurality of holes 104 spaced around the flange. The outer surface of the flange 102 is recessed at 106, FIG. 3, around each hole. The retaining shoe 100 overlies the low pressure side of the composite rim seal leaf 78 and overlaps the inner edge 83 of each of the rim seal metal strips 81 with the holes 104 in the retaining shoe registering with the clearance holes 88 in the metal strips. Respective ones of a plurality of threaded fasteners 108, such as machine screws, are received in the aligned holes 88 and 104 with the heads of the fasteners in the recesses 106. The fasteners 108 press the retaining shoe 100 against the low pressure side of the composite rim seal leaf 78 with a force calculated to achieve a practical gas seal between the high pressure side of the composite rim seal leaf and both the elastomeric seal element 76 and the rim seal bevel surface 66 but not so great as to prevent limited relative sliding movement between portions of the individual rim seal metal strips 81 and the rim seal bevel surface 66.

The composite cross arm seal leaf 80 is held on the engine by a retaining shoe 110 fabricated in one or more segments. The retaining shoe 110 includes a flange 112, FIG. 3, having a plurality of holes 114 spaced along the flange. The outer surface of the flange 112 is recessed at 116, FIG. 3, around each hole. The retaining shoe 110 overlies the low pressure side of the composite cross arm seal leaf 80 and overlaps the inner edge 92 of each of the cross arm metal strips 90 with the holes 114 in the retaining shoe registering with the clearance holes 95 in the metal strips. Respective ones of the plurality of threaded fasteners 108 are received in the aligned holes 114 and 95 with the heads of the fasteners in the recesses 116. The fasteners 108 press the retaining shoe 110 against the low pressure side of the composite cross arm leaf 80 with a force calculated to achieve a practical gas seal between the high pressure side of the composite cross arm seal leaf and both the elastomeric seal element 76 and the cross arm bevel surface 70 but not so great as to prevent limited relative sliding movement between portions of the individual cross arm metal strips 90 and the cross arm bevel surface 70.

Under static, engine-off conditions, the weight of the matrix disc is borne by the composite rim seal leaf 78 and the composite cross arm seal leaf 80. In addition, the composite seal leafs carry the compressive force applied by the corresponding composite leafs in the seal assembly 58 on the opposite side of the matrix disc. These compressive forces press the lips 96 and 97 of the composite leafs against the platform seal face 68 to effect a gas seal between the composite seal leafs and the platform seal face with only minimal elastic deformation of the composite seal leafs at the lips 96 and 97.

During and after engine start-up, air pressure in the regenerator compartment around the matrix disc increases from atmospheric to engine compressor discharge pressure and, through exposure to the high pressure sides of the composite rim seal leaf 78 and the composite cross arm seal leaf 80, presses the composite seal leafs more tightly against the platform seal face 68. The increased force improves the seal between the composite seal leafs and the platform and also forces the wear face 62 of the platform more tightly against the matrix disc to improve the seal therebetween.

Figure 5:
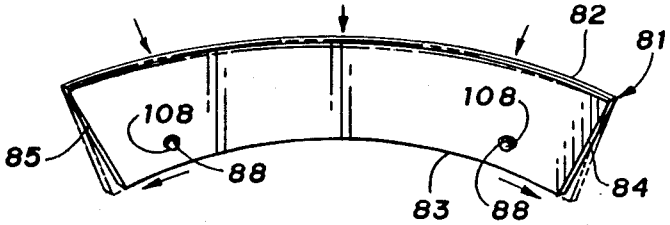
FIG. 5 is a schematic representation of one metal strip from the seal assembly according to this invention illustrating flexure of the metal strip.

Referring particularly to FIGS. 3–5, thermally induced distortion of the matrix disc 20 and the platform 60 locally reduces the size of the gap between the platform seal face 68 and the rim seal ledge 28. This gap reduction generates local downward forces on the outer edges 82 of some of the rim seal metal strips 81. Because the rim seal metal strips are held on the rim seal bevel surface in a flexed condition in the direction of the length dimensions thereof, the downward forces thereon urge the metal strips toward their natural, flat condition. Since the rim seal metal strips have no flanges along either edge which might resist deflection and are not rigidly clamped to the rim seal bevel surface, portions of the metal strips slide relative to the bevel surface 66, the elastomeric seal element 76, and the retaining shoe 100. For example, the rim seal metal strip 81 transitions from the solid line condition to the broken line condition shown in FIG. 5. By permitting this limited relative sliding movement, stress concentrations in the rim seal metal strips, which would otherwise arise if the latter were flanged along one edge or rigidly attached to the engine block, are avoided. The resilience of the elastomeric seal element 76 accommodates the slight changes in the curvature of the rim seal metal strips 81 in the direction of the length dimensions thereof which accompanies the transition of the metal strips to the more flat conditions. Similarly, the clearance between the holes 88 in the metal strips and the corresponding ones of the fasteners 108 prevents interference between the metal strips and the fasteners during the transitions.

With respect to the composite cross arm seal leaf 80, when the matrix disc 20 is cold and the end surface 26 thereof essentially flat, the line of contact between the platform seal face 68 and the cross arm seal lip 97 is a straight line. During engine operation, thermal gradients in the matrix disc distort the disc such that the end surface 26 thereof becomes convex and the platform seal face 68 become concave. The lip 97 on the composite cross arm seal leaf 80 is biased against the platform seal face 68 and follows the concavity thereof to maintain a tight seal. In order to follow the concave curvature of the platform seal face 68, the individual cross arm metal strips 90 must flex slightly in the direction of the length dimensions thereof from their initial flat conditions. Because the cross arm metal strips have no flanges along either edge which might resist deflection and are not rigidly clamped against the cross arm bevel surface 70, appropriate portions of the strips slide relative to the bevel surface without inducing stress concentrations which would otherwise arise if the cross arm metal strips were rigidly attached to the cross arm near the inner edges of the metal strips. The clearance between the holes 95 in the metal strips 90 and the corresponding ones of the fasteners 108 prevents interference between the metal strips and the fasteners during flexure of the metal strips.

The elastomeric seal element 76 in the grooves 72 and 74 improves the seal between the high and low pressure zones of the engine but may be susceptible to high temperature deterioration in some applications. In the event that acceptable service life cannot be achieved, the elastomeric seal element may be omitted from the seal assemblies 56 and 58. In embodiments without the elastomeric seal elements, the retaining shoes 100 and 110 press the high pressure sides of the composite rim seal leaf and the composite cross arm seal leaf directly against the rim seal bevel surface 66 and the cross arm bevel surface 70, respectively, with enough force to establish a gas seal which is practical in the sense that the overall efficiency of the engine is not fatally compromised.

The embodiments of the invention in which an exclusive property or privilege is claimed are defined as follows:

1. A seal assembly for disposition between a relatively higher pressure zone of a gas turbine engine and a relatively lower pressure zone of said gas turbine engine in a gap between an end surface of a regenerator matrix disc supported on an engine block of said gas turbine engine for rotation about an axis perpendicular to said end surface and a ledge on an adjoining portion of said engine block, said seal assembly comprising:

a flat seal platform non-rotatably connected to said engine block having a wear face slidably engaging said matrix disc end surface and a seal face opposite said rear face, means defining a bevel surface open said ledge facing said relatively lower pressure zone, means defining a seal groove in said bevel surface, an elastomeric seal element disposed in said seal groove and projecting above said bevel surface, a naturally planar thin and flexible metal strip having a high pressure side and a low pressure side and bounded by an inner edge and an outer edge and a pair of opposite ends, said metal strip being disposed on said bevel surface for limited sliding movement relative thereto with said high pressure side engaging said bevel surface and said seal element and with said outer edge of said metal strip engaging said platform seal face to define a gas seal between said platform and said metal strip, and retaining means on said engine block engaging said metal strip on said low pressure side and pressing said metal strip against said bevel surface and against said seal element with sufficient force to effect a gas seal between said metal strip high pressure side and said bevel surface but with insufficient force to rigidly clamp said metal strip at said inner edge thereof to said bevel surface.

2. A rim seal assembly for disposition between a relatively higher pressure zone of a gas turbine engine and a relatively lower pressure zone of said gas turbine engine in a gap between an end surface of a regenerator matrix disc supported on an engine block of said gas turbine engine for rotation about an axis perpendicular to said end surface and a ledge on an adjoining portion of said engine block defining an arc of a circle in a plane parallel to said matrix disc end surface, said rim seal assembly comprising:

a flat platform defining an arc of a circle and non-rotatably connected to said engine block having a wear face slidably engaging said matrix disc end surface and a seal face opposite said wear face, means defining a frustoconical bevel surface on said ledge facing said relatively lower pressure zone of said engine, means defining an arcuate seal groove in said bevel surface, an elastomeric seal element in said seal groove projecting above said bevel surface, a first a naturally planar thin and flexible metal strip having a high pressure side and a low pressure side and bounded by an arcuate inner edge and an arcuate outer edge and a pair of opposite ends, a second naturally planar thin and flexible metal strip having a high pressure side and a low pressure side and bounded by an arcuate inner edge and an arcuate outer edge and a pair of opposite ends, said first and said second metal strips being disposed on said bevel surface in end-to-end overlapping relationship for limited sliding movement relative to said bevel surface and to each other with said elastomeric seal element engaging said high pressure side of each of said first and said second metal strips and with said outer edge of each of said first and said second metal strips engaging said platform seal face to define a gas seal between said platform and each of said first and said second metal strips, and retaining means on said engine block engaging each of said first and said second metal strips on said low pressure side thereof and pressing each of said first and said second metal strips against said bevel surface and against said elastomeric seal element with sufficient force to effect a gas seal between said high pressure side of each of said first and said second metal strips and said bevel surface and said elastomeric seal element but with insufficient force to rigidly clamp each of said first and said second metal strips at said inner edges thereof to said bevel surface.

3. The rim seal assembly recited in claim 2 wherein said retaining means on said engine block pressing each of said first and said second metal strips against said bevel surface and against said elastomeric seal element includes an arcuate retaining shoe disposed over said low pressure side of each of said first and said second metal strips, and a plurality of fastener means on said engine block engaging said retaining shoe and pressing said shoe against said low pressure side of each of said first and said second metal strips.

4. A cross arm seal assembly for disposition between a relatively higher pressure zone of a gas turbine engine and a relatively lower pressure zone of said gas turbine engine in a gap between an end surface of a regenerator matrix disc supported on an engine block of said gas turbine engine for rotation about an axis perpendicular to said end surface and a ledge on a cross arm of said engine block, said cross arm seal assembly comprising:

a flat platform non-rotatably connected to said engine block having a wear face aligned with said cross arm slidably engaging said matrix disc end surface and a seal face opposite said wear face and aligned with said cross arm, means defining a bevel surface on said ledge facing said relatively lower pressure zone of said engine, means defining a linear seal groove in said bevel surface, an elastomeric seal element in said seal groove projecting above said bevel surface, a first naturally planar thin and flexible metal strip having a high pressure side and a low pressure side and bounded by a linear inner edge and a linear outer edge and a pair of opposite ends, a second naturally planar thin and flexible metal strip having a high pressure side and a low pressure side and bounded by a linear inner edge and a linear outer outer edge and a pair of opposite ends, each of said first and said second metal strips being disposed on said bevel surface in end-to-end overlapping relationship for limited sliding movement relative to said bevel surface and to each other with said elastomeric seal element engaging said high pressure side of each of said first and said second metal strips and with said outer edge of each of said first and said second metal strips engaging said platform seal face to define a gas seal between said platform and each of said first and said second metal strips, and retaining means on said engine block engaging each of said first and said second metal strips on said low pressure side thereof and pressing each of said first and said second metal strips against said bevel surface and against said elastomeric seal element with sufficient force to effect a gas seal between said high pressure side of each of said first and said second metal strips and said bevel surface and said elastomeric seal element but with insufficient force to rigidly clamp each of said first and said second metal strips at said inner edges thereof to said bevel surface.

5. The cross arm seal assembly recited in claim 4 wherein said retaining means on said engine block pressing each of said first and said second metal strips against said bevel surface and against said elastomeric seal element includes an retaining shoe having a linear segment disposed over said low pressure side of each of said first and said second metal strips, and a plurality of fastener means on said engine block engaging said retaining shoe and pressing said shoe against said low pressure side of each of said first and said second metal strips.

* * * * *